US007971315B2

(12) United States Patent
Kim et al.

(10) Patent No.: US 7,971,315 B2
(45) Date of Patent: Jul. 5, 2011

(54) SUCTION BRUSH FOR VACUUM CLEANER

(75) Inventors: Min-Ha Kim, Gwangju (KR); Jang-Keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 835 days.

(21) Appl. No.: 12/009,744

(22) Filed: Jan. 22, 2008

(65) Prior Publication Data

US 2009/0049643 A1 Feb. 26, 2009

(30) Foreign Application Priority Data

Aug. 21, 2007 (KR) ..... 10-2007-0084091

(51) Int. Cl.
*A47L 5/34* (2006.01)

(52) U.S. Cl. ..... 15/359; 15/354; 15/361; 15/319

(58) Field of Classification Search ..... 15/359–363, 15/354, 356, 319, 339, 246.2
See application file for complete search history.

(56) References Cited

U.S. PATENT DOCUMENTS 4,706,327 A 11/1987 Getz et al.
5,970,576 A * 10/1999 Maurer et al. ..... 15/354
6,591,447 B2 * 7/2003 Wegelin et al. ..... 15/359
2006/0101604 A1 * 5/2006 Frederick et al. ..... 15/319
2008/0072398 A1 * 3/2008 Moon ..... 15/354
2009/0020141 A1 1/2009 Dever

FOREIGN PATENT DOCUMENTS

KR 1020040086643 10/2004
KR 1020040100143 12/2004
KR 1020050063548 6/2005

OTHER PUBLICATIONS

Extended European Search Report for corresponding European Patent Application No. 08010872.3 dated May 31, 2010.

* cited by examiner

*Primary Examiner* — Dung Van Nguyen
(74) *Attorney, Agent, or Firm* — Ohlandt, Greeley, Ruggiero & Perle, LLP

(57) ABSTRACT

A suction brush for a vacuum cleaner includes an upper casing, a lower casing coupled to the upper casing and provided with a suction port through which contaminants are drawn in from a surface to be cleaned, a lift plate disposed between the upper casing and the lower casing to move up and down with respect to the lower casing, a lift plate driving part to allow the lift plate to move up and down, and a lift control unit to control the lift plate driving part so that when the surface to be cleaned changes from a hard floor to a carpet, the lift plate is raised, and when the surface to be cleaned changes from the carpet to the hard floor, the lift plate is lowered.

9 Claims, 5 Drawing Sheets

SUCTION BRUSH FOR VACUUM CLEANER

CROSS-REFERENCE TO RELATED APPLICATIONS

This application claims the benefit under 35 U.S.C. §119 (a) from Korean Patent Application No. 2007-84091 filed Aug. 21, 2007 in the Korean Intellectual Property Office, the disclosure of which is incorporated herein by reference in its entirety.

BACKGROUND OF THE INVENTION

1. Field of the Invention

The present disclosure relates to a suction brush for a vacuum cleaner. More particularly, the present disclosure relates to a suction brush for a vacuum cleaner capable of automatically controlling a gap between a lower casing provided with a suction port and a surface to be cleaned according to whether the surface to be cleaned is a hard floor or a carpet.

2. Description of the Related Art

Generally, vacuum cleaners are electric appliances that draw in and collect contaminants from a surface to be cleaned using a suction force generated by a vacuum generator. Various types of vacuum cleaners have been developed and used. A canister type vacuum cleaner generally includes a main body, a connection part, and a suction brush.

The vacuum generator such as a suction motor generating the suction force and a contaminants collecting part in which the drawn in contaminants are collected are disposed in the main body. The connection part includes a handle grasped by a user, an extension pipe connecting the handle and the suction brush, and a flexible hose connecting the handle and the main body. Also, the suction port is formed on a bottom surface of the suction brush so that the suction brush can draw in contaminants from the surface to be cleaned through the suction port.

The vacuum cleaner may be used to clean the surface to be cleaned such as a hard floor, and a carpet. Here, the hard floor refers to surfaces to be cleaned having a smooth surface such as, but not limited to, those formed of stone, wood, and linoleum.

When cleaning the hard floor, the suction brush of the vacuum cleaner is often stuck to the surface to be cleaned. When the suction brush is stuck to the surface to be cleaned, a handling resistance of the suction brush is increased. So a user is required to apply a greater force to handle the suction brush. When cleaning the surface to be cleaned like the carpet, the suction brush is stuck to the carpet less often than the hard floor. However, when cleaning the carpet, the vacuum cleaner needs to use the suction force greater than that used for cleaning the hard floor in order to draw in contaminants among tight wool or fibers (herein after "wool") of the carpet.

The handing resistance and suction force of the suction brush with respect to the surface to be cleaned are closely related to a gap between the surface to be cleaned and the bottom surface of the suction brush on which the suction port is formed. That is, as the gap between the surface to be cleaned and the bottom surface of the suction brush decreases, the handling resistance and suction force increase. As the gap between the surface to be cleaned and the bottom surface of the suction brush increases, the handling resistance and suction force decrease.

Therefore, in the case of the suction brush constantly maintaining the gap between the surface to be cleaned and the bottom surface of the suction brush, when cleaning the hard floor, the handling resistance is increased so that a user is required to use a lot of force to handle the suction brush. Also, when cleaning the carpet, the suction force is weak so that the suction brush cannot effectively draw in contaminants between wool of the carpet.

To solve the problem, suction brushes that can adjust the gap between the surface to be cleaned and the bottom surface of the suction brush according to types of the surfaces to be cleaned have been developed. The suction brushes have a lever projecting from a top surface thereof to be manually handled by a user. Therefore, when cleaning the hard floor, the user controls the lever to increase the gap between the surface to be cleaned and the bottom surface of the suction brush, thereby reducing the handling resistance. When cleaning the carpet, the user controls the lever to decrease the gap between the surface to be cleaned and the bottom surface of the suction brush, thereby increasing the suction force.

However, because the suction brush is configured so that the user manually controls the lever to adjust the gap between the bottom surface of the suction brush and the surface to be cleaned, whenever the type of the surface to be cleaned changes, the user should manually control the lever. As a result, the use of the vacuum cleaner may feel onerous.

SUMMARY OF THE INVENTION

The present disclosure has been developed in order to overcome the above drawbacks and other problems associated with the conventional arrangement. An aspect of the present disclosure is to provide a suction brush for a vacuum cleaner that can automatically adjust a gap between a bottom surface thereof on which a suction port is formed and a surface to be cleaned when the surface to be cleaned changes from a hard floor to a carpet or from the carpet to the hard floor.

The above aspect and/or other features of the present disclosure can substantially be achieved by providing a suction brush for a vacuum cleaner, which includes an upper casing; a lower casing coupled to the upper casing, and provided with a suction port through which contaminants are drawn in from a surface to be cleaned; a lift plate disposed between the upper casing and the lower casing to move up and down with respect to the lower casing; a lift plate driving part to allow the lift plate to move up and down; and a lift control unit to control the lift plate driving part so that when the surface to be cleaned changes from a hard floor to a carpet, the lift plate is raised, and when the surface to be cleaned changes from the carpet to the hard floor, the lift plate is lowered; wherein the lower casing contacts the surface to be cleaned as the lift plate is raised, and the lower casing is spaced apart from the surface to be cleaned as the lift plate is lowered.

The lift plate driving part includes a driving shaft disposed parallel to the lift plate above the lift plate; a DC motor to rotate the driving shaft; at least one driving cam formed to project radially from an outer circumferential surface of the driving shaft; and a battery to supply the DC motor with electrical power; wherein a receiving portion is recessed on an upper surface of the lift plate to receive either of the driving shaft or the driving cam.

When the driving shaft is received in the receiving portion, the lift plate is raised with respect to the lower casing. When the driving cam is received in the receiving portion, the lift plate is pressed by the driving cam to lower with respect to the lower casing.

The lift control unit includes a surface detecting part to detect whether the surface to be cleaned is the hard floor or the carpet; a first DC motor driving part to operate the DC motor so that when the surface to be cleaned changes from the hard floor to the carpet, the driving shaft is received in the receiving portion; and a second DC motor driving part to operate the DC motor so that when the surface to be cleaned changes from the carpet to the hard floor, the driving cam is received in the receiving portion.

The first DC motor driving part includes a first micro switch disposed near a side of the driving shaft; and a first control cam formed on the driving shaft so that when the driving shaft is received in the receiving portion, the first control cam allows the first micro switch to maintain an open state.

The second DC motor driving part includes a second micro switch disposed side by side with the first micro switch near the side of the driving shaft; and a second control cam formed on the driving shaft so that when the driving cam is received in the receiving portion, the second control cam allows the second micro switch to maintain an open state.

The DC motor is electrically connected with the first and second micro switches, wherein when the surface to be cleaned is detected as the carpet, the DC motor rotates in one direction until the first micro switch is in the open state, and wherein when the surface to be cleaned is detected as the hard floor, the DC motor rotates in the same direction until the second micro switch is in the open state.

The surface detecting part includes a fixing plate horizontally spaced apart from the surface to be cleaned; a third micro switch disposed above the fixing plate and electrically connected with the first micro switch and the second micro switch; and a rotation member rotatably disposed at the fixing plate to have a surface contacting portion formed on one end thereof to contact the surface to be cleaned, and a switch contacting portion formed on the other end thereof to contact a contacting terminal of the third micro switch.

The suction brush may include a power switch part configured to cut off electrical power supplied from the battery to the DC motor when the suction brush is spaced apart from the surface to be cleaned.

With the suction brush of the vacuum cleaner according to an embodiment of the present disclosure, the gap between the lower casing on which the suction port is formed and the surface to be cleaned can be automatically adjusted according to whether the surface to be cleaned is the hard floor or the carpet.

Also, with the suction brush of the vacuum cleaner according to an embodiment of the present disclosure, the DC motor that rotates only in one direction can be used to adjust the gap between the lower casing and the surface to be cleaned. Therefore, the manufacturing cost may be decreased as compared to the suction brush using a reversible motor.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, a suction brush for a vacuum cleaner according to an exemplary embodiment of the present disclosure will be described in detail with reference to the accompanying drawings.

The matters defined in the description, such as a detailed construction and elements thereof, are provided to assist in a comprehensive understanding of the disclosure. Thus, if is apparent that the present disclosure may be carried out without those defined matters. Also, well-known functions or constructions are omitted to provide a clear and concise description of exemplary embodiments of the present disclosure.

Figure 1:
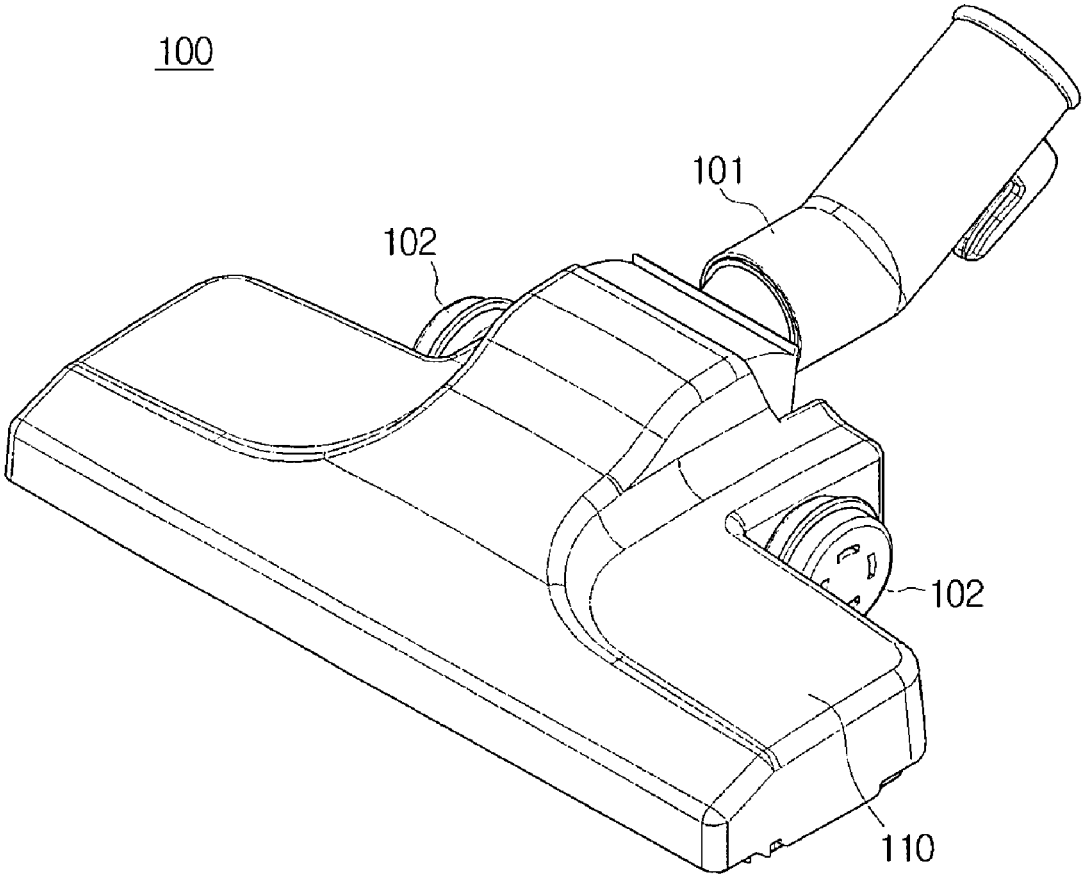
FIG. 1 is a perspective view illustrating a suction brush for a vacuum cleaner according to an embodiment of the present disclosure.
Figure 2:
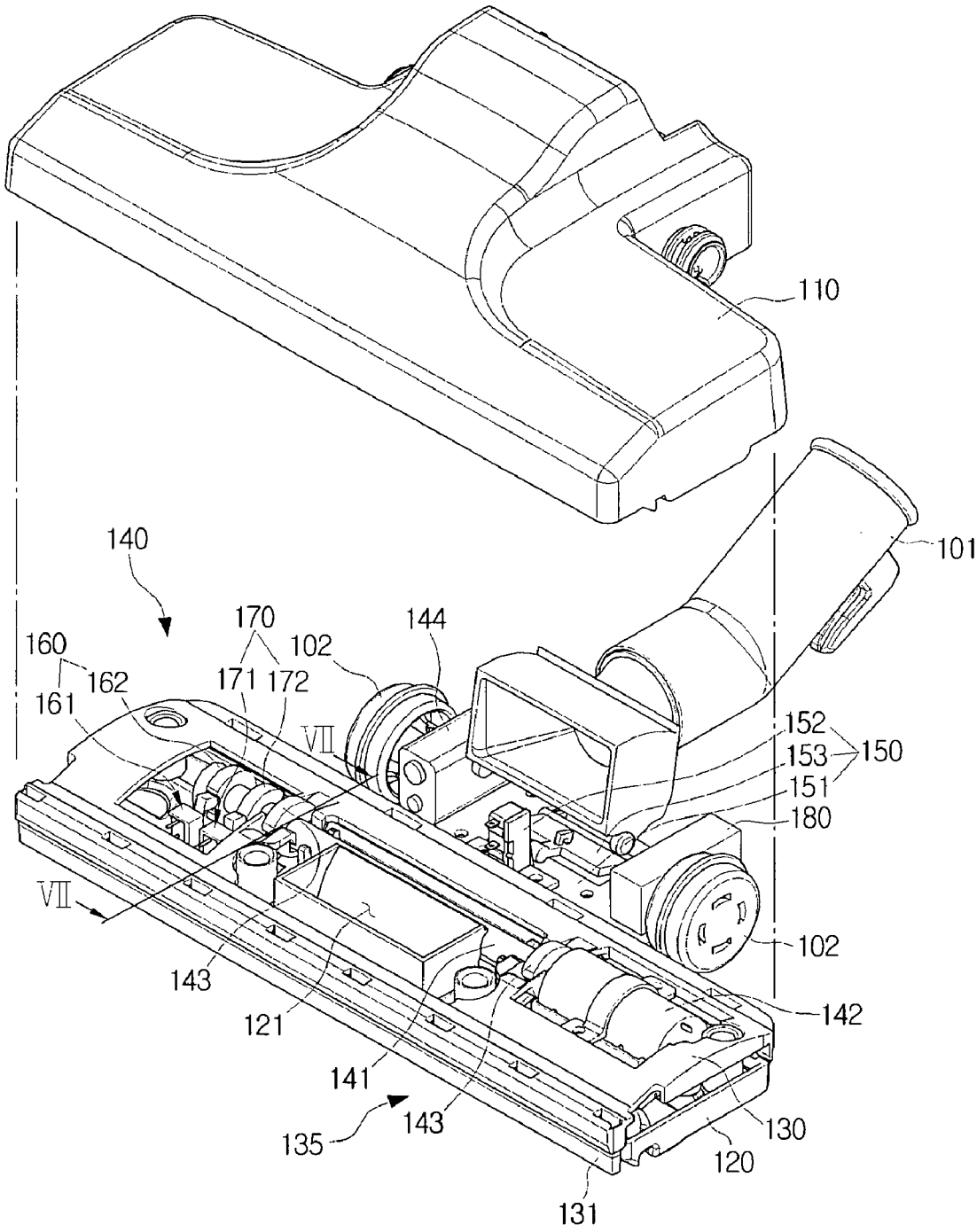
FIG. 2 is a perspective view illustrating the suction brush of FIG. 1 with a separated upper casing.
Figure 3:
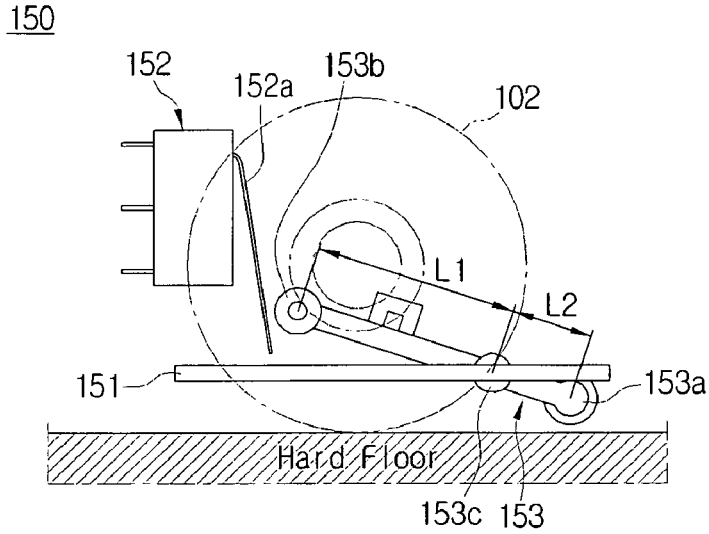
FIG. 3 is a side view illustrating a surface detecting part of the suction brush of FIG. 1 locating on a hard floor.
Figure 4:
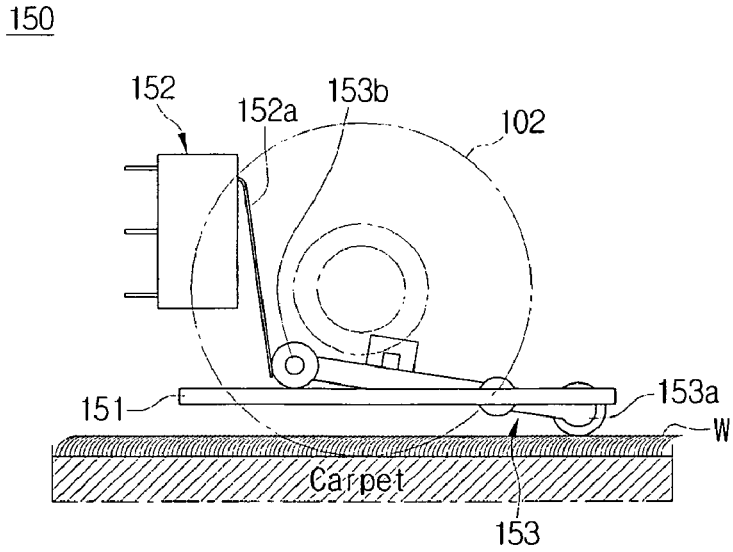
FIG. 4 is a side view illustrating a surface detecting part of the suction brush of FIG. 1 locating on a carpet.
Figure 5:
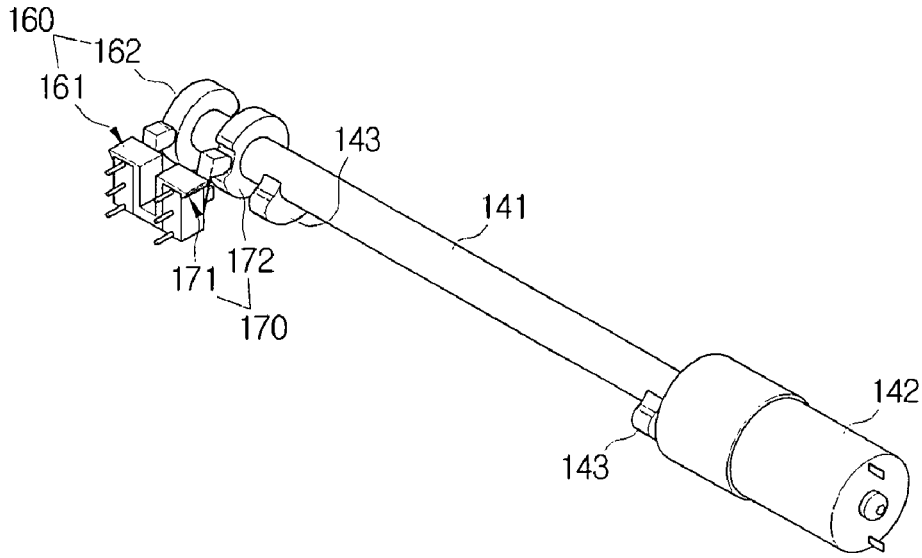
FIG. 5 is a perspective view illustrating a lift plate driving part, a first DC motor control part, and a second DC motor control part of the suction brush of FIG. 1 when locating on a hard floor.
Figure 6:
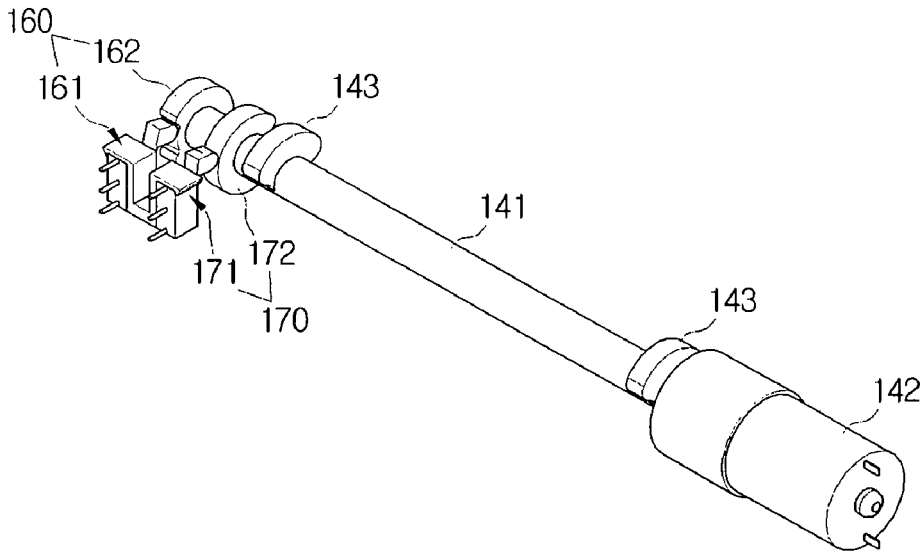
FIG. 6 is a perspective view illustrating a lift plate driving part, a first DC motor control part, and a second DC motor control part of the suction brush of FIG. 1 when locating on a carpet.
Figure 7:
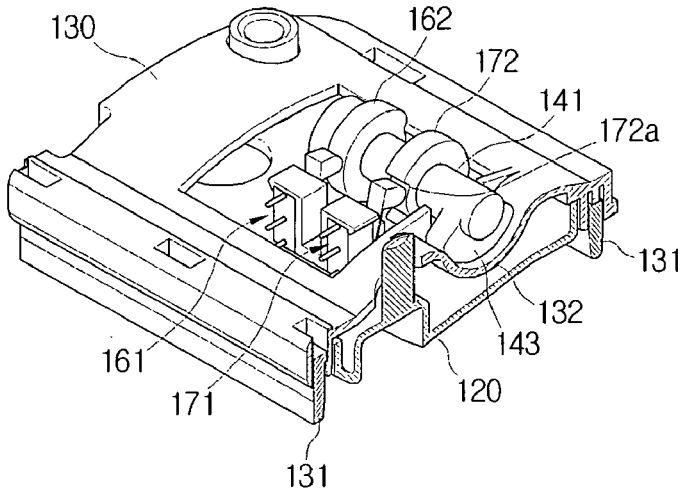
FIG. 7 is a sectional perspective view illustrating the suction brush of FIG. 2 taken along a line VII-VII when locating on a hard floor.
Figure 8:
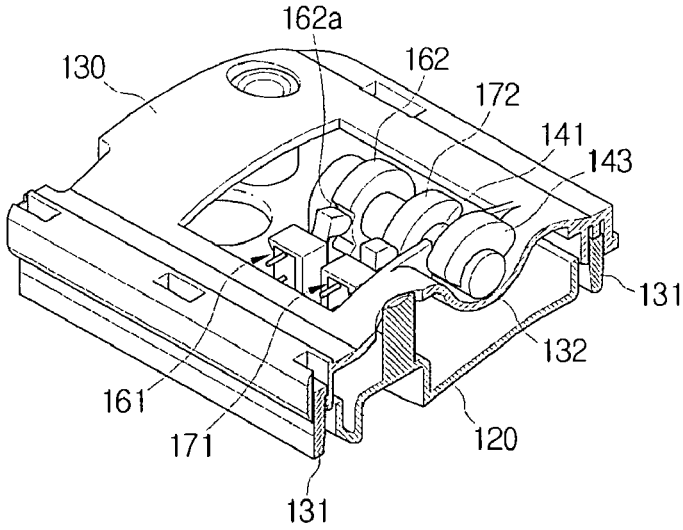
FIG. 8 is a sectional perspective view illustrating the suction brush of FIG. 2 taken along a line VII-VII when locating on a carpet.

FIG. 1 is a perspective view illustrating a suction brush for a vacuum cleaner according to an exemplary embodiment of the present disclosure. FIG. 2 is a perspective view illustrating the suction brush of FIG. 1 with a separated upper casing. FIG. 3 is a side view illustrating a surface detecting part of the suction brush of FIG. 1 locating on a hard floor, and FIG. 4 is a side view illustrating the surface detecting part of the suction brush of FIG. 1 locating on a carpet. FIG. 5 is a perspective view illustrating a lift plate driving part, a first DC motor control part, and a second DC motor control part of the suction brush of FIG. 1 when locating on the hard floor. FIG. 6 is a perspective view illustrating the lift plate driving part, the first DC motor control part, and the second DC motor control part of the suction brush of FIG. 1 when locating on the carpet. FIG. 7 is a sectional perspective view illustrating the suction brush of FIG. 2 taken along a line VII-VII when locating on the hard floor; and FIG. 8 is a sectional perspective view illustrating the suction brush of FIG. 2 taken along a line VII-VII when locating on the carpet.

Referring to FIGS. 1 to 8, the suction brush 100 for the vacuum cleaner according to this embodiment includes the upper casing 110, a lower casing 120, a lift plate 130, a lift plate driving part 135, and a lift control unit 140.

The upper casing 110 and the lower casing 120 are coupled each other. The lower casing 120 is formed to face a surface to be cleaned during cleaning. A suction port 121, through which contaminants are drawn in with air from the surface to be cleaned, is formed at a middle area of the lower casing 120. Contaminants drawn in through the suction port 121 are guided to an extension pipe connector 101 by a guiding passage (not illustrated) formed in the upper casing 110.

The lift plate 130 is disposed between the upper casing 110 and lower casing 120 to move up and down with respect to the lower casing 120. Referring FIGS. 2 and 7, a pair of ribs 131 is inserted in opposite ends of the lift plate 130 in a width direction thereof. When the lift plate 130 moves up, the lower casing 120 relatively moves down to closely contact the surface to be cleaned. When the lift plate 130 moves down, the lower casing 120 relatively moves up to be spaced apart from the surface to be cleaned.

Referring to FIGS. 2, 5, and 6, the lift plate driving part 135 includes a driving shaft 141, a direct current motor (hereinafter, referred to as a DC motor) 142, a pair of driving cam 143, and a battery 144.

The driving shaft 141 is arranged parallel to the lift plate 130 above the lift plate 130. The driving shaft 141 is connected to the DC motor 142 so that the driving shaft 141 is rotated by the DC motor 142. The DC motor 142 is electrically connected to the battery 144 to receive electrical power from the battery 144. The pair of driving cams 143 is disposed at opposite ends of the driving shaft 141. Each of the driving cams 143 is formed substantially in a fan shape and projects from an outer circumferential surface of the driving shaft 141 in a radial direction of the driving shaft 141.

Referring to FIGS. 7 and 8, a receiving portion 132 is recessed on an upper surface of the lift plate 130 to receive the driving cams 143. The receiving portion 132 can also receive a portion of the driving shaft 141 below the driving cam 143. As seen in FIG. 7, when the driving cam 143 is received on the receiving portion 132 of the lift plate 130, the driving cam 143 compresses downwardly the lift plate 130 to be lowered relatively with respect to the lower casing 120. As seen in FIG. 8, when the portion of the driving shaft 141 below the driving cam 143 is received on the receiving portion 132 of the lift plate 130, the lift plate 130 is relatively raised with respect to the lower casing 120.

The lift control unit 140 controls the lift plate driving part 135 according to types of the surface to be cleaned. For example, when the surface to be cleaned changes from the hard floor to the carpet, the lift control unit 140 controls the lift plate driving part 135 to raise the lift plate 130. When the surface to be cleaned changes from the carpet to the hard floor, the lift control unit 140 controls the lift plate driving part 135 to lower the lift plate 130. Therefore, when the surface to be cleaned is the carpet, the lower casing 120 is maintained in close contact with the carpet by the lift control unit 140. When the surface to be cleaned is the hard floor, the lower casing 120 is maintained spaced apart from the hard floor by the lift control unit 140.

The lift control unit 140, referring to FIGS. 2, 5, and 6, includes the surface detecting part 150, a first DC motor driving part 160, and a second DC motor driving part 170.

Referring to FIG. 2, the surface detecting part 150 is disposed between a pair of suction brush wheels 102 and detects whether the surface to be cleaned is the hard floor or the carpet. Referring to FIGS. 3 and 4, the surface detecting part 150 includes a fixing plate 151, a third micro switch 152, and a rotation member 153.

The fixing plate 151 is spaced in a predetermined height apart from the surface to be cleaned and remains substantially horizontal with respect to the surface to be cleaned.

The third micro switch 152 is disposed above the fixing plate 151 and has a contacting terminal 152*a* disposed near the rotation member 153. The third micro switch 152 is electrically connected with first and second micro switches 161 and 162, which will be described later.

The rotation member 153 is rotatably disposed at the fixing plate 151. At one end of the rotation member 153 is formed a surface contacting portion 153*a* that can contact the surface to be cleaned. At the other end of the rotation member 153 is formed a switch contacting portion 153*b* that can contact the contacting terminal 152*a* of the third micro switch 152. The surface contacting portion 153*a* and switch contacting portion 153*b* may be formed in a roller.

When the surface to be cleaned is the hard floor as illustrated in FIG. 3, the switch contacting portion 153*b* of the rotation member 153 does not contact and is spaced apart from the contacting terminal 152*a*. The state where the switch contacting portion 153*b* is spaced apart from the contacting terminal 152*a* of the third micro switch 152 is hereafter referred to as an open state of the third micro switch 152.

When the surface to be cleaned changes into the carpet as illustrated in FIG. 4, the surface contacting portion 153*a* of the rotation member 153 is raised as much as the height of wool W of the carpet. At this time, the height of fixing plate 151 from the surface to be cleaned is maintained constantly so that the rotation member 153 rotates by a predetermined angle. So, the switch contacting portion 153*b* of the rotation member 153 is lowered to contact and press the contacting terminal 152*a* of the third micro switch 152. The state where the switch contacting portion 153*b* contacts and presses the contacting terminal 152*a* of the third micro switch 152 is hereafter referred to as a closed state of the third micro switch 152.

A first length L1 from a rotation center 153*c* to the switch contacting portion 153*b* of the rotation member 153 may be longer than a second length L2 from the rotation center 153*c* to the surface contacting portion 153*a* of the rotation member 153. In this embodiment, the first length L1 from the rotation center 153*c* to the switch contacting portion 153*b* of the rotation member 153 is approximately five times as long as the second length L2 from the rotation center 153*c* to the surface contacting portion 153*a* of the rotation member 153. In this case, when the surface contacting portion 153*a* is raised by approximately 1 mm, the switch contacting portion 153*b* is lowered by approximately 5 mm. As a result, even when the surface to be cleaned is a carpet with relatively short wool W, the surface detecting part 150 can detect whether the surface to be cleaned is the carpet.

Referring to FIGS. 5 to 8, the first DC motor driving part 160 includes the first micro switch 161 disposed near a side of the driving shaft 141, and a first control cam 162 that opens and closes the first micro switch 161.

As illustrated in FIGS. 5 and 7, when the driving cam 143 locates below the driving shaft 141 to be received in the receiving portion 132 of the lift plate 130, the first control cam 162 causes the first micro switch 161 to be in a closed state. As illustrated in FIGS. 6 and 8, when the driving shaft 141 locates below the driving cam 143 to be received in the receiving portion 132 of the lift plate 130, the first control cam 162 causes the first micro switch 161 to be in an open state.

Here, the closed state of the first micro switch 161 refers to a state that a contacting terminal of the first micro switch 161 is pressed by an outer circumferential surface of the first control cam 162 as illustrated in FIG. 7. The open state of the first micro switch 161 refers to a state that the contacting terminal of the first micro switch 161 locates in a recess portion 162*a* of the outer circumferential surface of the first control cam 162 and is not pressed by the outer circumferential surface of the first control cam 162 as illustrated in FIG. 8. When the first micro switch 161 is in the closed state, the electrical connection between the first micro switch 161 and the DC motor 142 is maintained. However, when the first micro switch 161 is in the open state, the electrical connection between the first micro switch 161 and the DC motor 142 is cut off.

When the surface detecting part 150 detects the carpet, that is, the third micro switch 152 is in the closed state (see FIG. 4), the electrical connection between the second micro switch 171 and the DC motor 142 is cut off. As a result, the rotation of the DC motor 152 is controlled by open and closed operations of the first micro switch 161 regardless of the second micro switch 171. When the first micro switch 161 is in the closed state, the DC motor 142 may be set to operate.

For example, when the surface to be cleaned changes from the hard floor to the carpet, as illustrated in FIG. 4, the third micro switch 152 is closed so that the DC motor 142 is controlled by the first micro switch 161. At this time, the first micro switch 161 maintains the closed state on the hard floor as illustrated in FIG. 7 so that the DC motor 142 operates the driving shaft 141 to rotate. When the driving shaft 141 rotates by approximately 180 degrees, the first micro switch 161 is in the open state as illustrated in FIG. 8 so that the DC motor 142 stops.

Referring to FIGS. 5 to 8, the second DC motor driving part 170 includes the second micro switch 171 disposed side by side with the first micro switch 161 near the side of the driving shaft 141, and a second control cam 172 that opens and closes the second micro switch 171.

As illustrated in FIGS. 5 and 7, when the driving cam 143 is located below the driving shaft 141 so as to be received in the receiving portion 132 of the lift plate 130, the second control cam 172 causes the second micro switch 171 to be in an open state. As illustrated in FIGS. 6 and 8, when the driving shaft 141 is located below the driving cam 143 so that the portion of the driving shaft 141 below the driving cam 143 is received in the receiving portion 132 of the lift plate 130, the second control cam 172 causes the second micro switch 171 to be in a closed state.

Here, the closed state of the second micro switch 171 refers to a state where a contacting terminal of the second micro switch 171 is pressed by an outer circumferential surface of the second control cam 172 as illustrated in FIG. 8. The open state of the second micro switch 171 refers to a state where the contacting terminal of the second micro switch 171 is located in a recess portion 172*a* of the outer circumferential surface of the second control cam 172 and is not pressed by the outer circumferential surface of the second control cam 172 as illustrated in FIG. 7. When the second micro switch 171 is in the closed state, the electrical connection between the second micro switch 171 and the DC motor 142 is maintained. However, when the second micro switch 171 is in the open state, the electrical connection between the second micro switch 171 and the DC motor 142 is cut off.

When the surface detecting part 150 detects the hard floor, that is, the third micro switch 152 is in the open state (see FIG. 3), the electrical connection between the first micro switch 161 and the DC motor 142 is cut off. As a result, the rotation of the DC motor 142 is controlled by opening and closing the second micro switch 171 regardless of the first micro switch 161. When the second micro switch 171 is in the closed state, the DC motor 142 may be set to operate.

For example, when the surface to be cleaned changes from the carpet to the hard floor, as illustrated in FIG. 3, the third micro switch 152 is in the open state so that the DC motor 142 is controlled by the second micro switch 171. At this time, the second micro switch 171 is maintained in the closed state on the carpet as illustrated in FIG. 8 so that the DC motor 142 operates the driving shaft 141 to rotate. When the driving shaft 141 rotates by approximately 180 degrees, the second micro switch 171 is in the open state as illustrated in FIG. 7 so that the DC motor 142 stops.

As described above, when the surface to be cleaned changes from the hard floor to the carpet, the DC motor 142 rotates the driving shaft 141 by approximately 180 degrees until the first micro switch 161 changes from the closed state to the open state. When the surface to be cleaned changes from the carpet to the hard floor, the DC motor 142 rotates the driving shaft 141 by another approximately 180 degrees until the second micro switch 171 changes from the closed state to the open state.

In the present disclosure, when the surface to be cleaned changes from the hard floor to the carpet or from the carpet to the hard floor, the driving shaft 141 is required to rotate by approximately 180 degrees regardless of a rotational direction. Therefore, the DC motor 142 is not required to use a reversible motor. A motor that rotates only in one direction can be used as the DC motor 142.

Referring to FIG. 2, the suction brush 100 is provided with a power switch part 180 that cuts off the electric power supplied from the battery 144 to the DC motor 142. Although not illustrated, a power switch (not illustrated) that can contact the surface to be cleaned can be disposed on a bottom of the power switch part 180. When the suction brush 100 is on the surface to be cleaned, the power switch contacts the surface to be cleaned so that the electric power is supplied from the battery 144 to the DC motor 142. However, when the suction brush 100 is spaced apart from the surface to be cleaned, the power switch is turned off so that an electrical connection between the battery 144 and the DC motor 142 is cut off. As a result, the electric power is not supplied from the battery 144 to the DC motor 142.

Hereinafter, operations of the suction brush 100 for the vacuum cleaner according to an embodiment of the present disclosure having the above-described structure will be explained when the surface to be cleaned changes from the hard floor to the carpet during a cleaning work and when the surface to be cleaned changes from the carpet to the hard floor during the cleaning work.

First, when the surface to be cleaned changes from the hard floor to the carpet during the cleaning work, the operation of the suction brush 100 is explained with reference to FIGS. 3, 4, 7, and 8.

When a user is cleaning the hard floor using the suction brush 100, as illustrated in FIG. 7, the driving cam 143 presses the receiving portion 132 of the lift plate 130. At this time, the lift plate 130 is lowered, so the lower casing 120 is relatively raised. Therefore, a gap between the lower casing 120 and the surface to be cleaned is greater when the surface to be cleaned is the hard floor than when the surface to be cleaned is the carpet. As a result, it is reduced that the lower casing 120 is stuck to the surface to be cleaned due to the suction force. Therefore, the handling resistance of the suction brush 100 can be decreased.

When the user is cleaning the hard floor using the suction brush 100, as illustrated in FIG. 3, the switch contacting portion 153*b* of the rotation member 153 is spaced apart from the contacting terminal 152*a* of the third micro switch 152 so that the third micro switch 152 maintains the open state. In other words, the surface detecting part 150 detects the surface to be cleaned as the hard floor. When the surface to be cleaned is detected as the hard floor, the second DC motor driving part 170 controls the DC motor 142. For example, when the second micro switch 171 is in the closed state, the DC motor 142 operates to rotate the driving shaft 141. However, if the surface to be cleaned is the hard floor, as illustrated in FIG. 7, the second micro switch 171 is in the open state so that the DC motor 142 does not operate.

When the user moves the suction brush 100 from the hard floor to the carpet, that is, the surface to be cleaned changes from the hard floor to the carpet, as illustrated in FIG. 4, the switch contacting portion 153*b* of the rotation member 153 contacts and presses the contacting terminal 152*a* of the third micro switch 152. Therefore, the surface detecting part 150 changes so as to detect the surface to be cleaned as the carpet.

When the surface to be cleaned is detected as the carpet, the first DC motor driving part 160 controls the DC motor 142. For example, when the first micro switch 161 is in the closed state, the DC motor 142 operates to rotate the driving shaft 141. When the surface to be cleaned changes from the hard floor to the carpet, as illustrated in FIG. 7, the first micro switch 161 is maintained in the closed state by the first driving cam 162 so that the DC motor 142 operates to rotate the driving shaft 141 in a direction. When the driving shaft 141 rotates by approximately 180 degrees in the direction, the first driving cam 162 allows the first micro switch 161 to move to the open state as illustrated in FIG. 8 so that the DC motor 142 stops.

During this process, the portion of the driving shaft 141 below the driving cam 143 is received in the receiving portion 132 of the lift plate 130 so that the lift plate 130 is raised and the lower casing 120 is relatively lowered. Therefore, the lower casing 120 closely contacts the carpet as compared to the hard floor. As a result, the suction brush 100 can effectively draw in contaminants among wool W of the carpet.

When the user is cleaning the carpet, the user can lift up the suction brush 100 to be spaced apart from the carpet. At this time, the surface detecting part 150 changes from the state of FIG. 4 to the state of FIG. 3. That is, the surface detecting part 150 changes to detect the surface to be cleaned as the hard floor. However, when the user lifts up the suction brush 100, the power switch of the power switch part 180 (see FIG. 8) disposed at the suction brush 100 is turned off to prevent the DC motor 142 from operating.

Next, referring to FIGS. 3, 4, 7 and 8, when the surface to be cleaned changes from the carpet to the hard floor during the cleaning work, the operation of the suction brush 100 is explained.

When the user is cleaning the carpet, the lower casing 120 maintains close contact with the carpet as illustrated in FIG. 8. At this time, the surface detecting part 150 of the suction brush 100 allows the third micro switch 152 to maintain the closed state as illustrated in FIG. 4.

When the user moves the suction brush 100 from the carpet to the hard floor, that is, the surface to be cleaned changes from the carpet to the hard floor, as illustrated in FIG. 3, the third micro switch 152 is in the open state so that the surface detecting part 150 detects the surface to be cleaned as the hard floor.

When the surface to be cleaned is detected as the hard floor, the second DC motor driving part 170 controls the DC motor 142. For example, when the second micro switch 171 is in the closed state, the DC motor 142 operates to rotate the driving shaft 141. When the surface to be cleaned changes from the carpet to the hard floor, as illustrated in FIG. 8, the second micro switch 171 is maintained in the closed state by the second driving cam 172 so that the DC motor 142 operates to rotate the driving shaft 141 in the direction. When the driving shaft 141 rotates by approximately 180 degrees in the direction, the second driving cam 172 allows the second micro switch 171 to move to the open state as illustrated in FIG. 7 so that the DC motor 142 stops.

During this process, the driving cam 143 is received in the receiving portion 132 of the lift plate 130 so that the lift plate 130 is pressed by the driving cam 143 to be lowered, and the lower casing 120 is relatively raised. Therefore, the gap between the lower casing 120 and the surface to be cleaned becomes greater when the surface to be cleaned is the hard floor than when the surface to be cleaned is the carpet. As a result, a phenomenon that the lower casing 120 is stuck to the surface to be cleaned due to the suction force may be reduced. Therefore, the handling resistance of the suction brush 100 can be decreased.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the disclosure.

What is claimed is:

1. A suction brush for a vacuum cleaner comprising:

an upper casing;

a lower casing coupled to the upper casing, the lower casing being provided with a suction port through which contaminants are drawn in from a surface to be cleaned;

a lift plate disposed between the upper casing and the lower casing so as to move up and down with respect to the lower casing;

a lift plate driving part to allow the lift plate to move up and down; and a lift control unit to control the lift plate driving part so that when the surface to be cleaned changes from a hard floor to a carpet, the lift plate is raised, and when the surface to be cleaned changes from the carpet to the hard floor, the lift plate is lowered, wherein the lower casing contacts the surface to be cleaned when the lift plate is raised, and the lower casing is spaced apart from the surface to be cleaned when the lift plate is lowered.

2. The suction brush of claim 1, wherein the lift plate driving part comprises:

a driving shaft disposed parallel to the lift plate above the lift plate;

a DC motor configured to rotate the driving shaft;

at least one driving cam formed to project radially from an outer circumferential surface of the driving shaft; and a battery to supply the DC motor with electrical power, wherein a receiving portion is recessed on an upper surface of the lift plate to receive either of the driving shaft or the driving cam.

3. The suction brush of claim 2, wherein when the driving shaft is received in the receiving portion, the lift plate is raised with respect to the lower casing, and when the driving cam is received in the receiving portion, the lift plate is pressed by the driving cam to lower with respect to the lower casing.

4. The suction brush of claim 3, wherein the lift control unit comprises:

a surface detecting part to detect whether the surface to be cleaned is the hard floor or the carpet;

a first DC motor driving part to operate the DC motor so that when the surface to be cleaned changes from the hard floor to the carpet, the driving shaft is received in the receiving portion; and a second DC motor driving part to operate the DC motor so that when the surface to be cleaned changes from the carpet to the hard floor, the driving cam is received in the receiving portion.

5. The suction brush of claim 4, wherein the first DC motor driving part comprises:

a first micro switch disposed near a side of the driving shaft; and a first control cam formed on the driving shaft so that when the driving shaft is received in the receiving portion, the first control cam allows the first micro switch to maintain an open state.

6. The suction brush of claim 5, wherein the second DC motor driving part comprises:

a second micro switch disposed side by side with the first micro switch near the side of the driving shaft; and a second control cam formed on the driving shaft so that when the driving cam is received in the receiving portion, the second control cam allows the second micro switch to maintain an open state.

7. The suction brush of claim 6, wherein the DC motor is electrically connected with the first and second micro switches, wherein when the surface to be cleaned is detected as the carpet, the DC motor rotates in one direction until the first micro switch is in the open state, and wherein when the surface to be cleaned is detected as the hard floor, the DC motor rotates in the same direction until the second micro switch is in the open state.

8. The suction brush of claim 4, wherein the surface detecting part comprises:

a fixing plate horizontally spaced apart from the surface to be cleaned;

a third micro switch disposed above the fixing plate and electrically connected with the first micro switch and the second micro switch; and a rotation member rotatably disposed at the fixing plate to have a surface contacting portion formed on one end thereof to contact the surface to be cleaned, and a switch contacting portion formed on the other end thereof to contact a contacting terminal of the third micro switch.

9. The suction brush of claim 2, further comprising:

a power switch part configured to cut off electrical power supplied from the battery to the DC motor when the suction brush is spaced apart from the surface to be cleaned.

* * * * *